US008468921B2

(12) United States Patent
Ruhland et al.

(10) Patent No.: US 8,468,921 B2
(45) Date of Patent: Jun. 25, 2013

(54) BRUSH CYLINDER

(75) Inventors: Karl Ruhland, Pfreimd (DE); Karl Waldeck, Etzenricht (DE)

(73) Assignee: BHS Corrugated Maschinen-und Anlagenbau GmbH, Weiherhammer (DE)

( * ) Notice: Subject to any disclaimer, the term of this patent is extended or adjusted under 35 U.S.C. 154(b) by 842 days.

(21) Appl. No.: 10/572,581

(22) PCT Filed: May 24, 2005

(86) PCT No.: PCT/EP2005/005590

§ 371 (c)(1),
(2), (4) Date: Mar. 20, 2006

(87) PCT Pub. No.: WO2005/118238

PCT Pub. Date: Dec. 15, 2005

(65) Prior Publication Data

US 2007/0028741 A1 Feb. 8, 2007

(30) Foreign Application Priority Data

May 26, 2004 (DE) ..... 10 2004 026 321

(51) Int. Cl.
*B26D 1/15* (2006.01)
*B26D 1/22* (2006.01)
*B26D 7/20* (2006.01)

(52) U.S. Cl.
USPC ..... 83/347; 83/659; 83/698.41; 411/307; 492/29

(58) Field of Classification Search
USPC ..... 492/28, 29; 83/37, 343, 346, 347, 83/659, 698.41, 698.42, 698.51, 698.61; 411/307; 493/370
See application file for complete search history.

(56) References Cited

U.S. PATENT DOCUMENTS

| | | | | | |
|---|---|---|---|---|---|
| 1,539,826 | A | * | 6/1925 | Boutelle | 351/99 |
| 2,360,826 | A | * | 10/1944 | Cherry | 411/166 |
| 2,485,280 | A | * | 10/1949 | Grace | 254/98 |
| 3,285,642 | A | | 11/1966 | Sauer | |
| 3,405,751 | A | * | 10/1968 | Parr | 411/307 |
| 3,604,302 | A | | 9/1971 | Smythe | |
| 3,618,436 | A | | 11/1971 | Brown | |
| 3,876,318 | A | * | 4/1975 | Crispell | 403/290 |

(Continued)

FOREIGN PATENT DOCUMENTS

| | | | |
|---|---|---|---|
| DE | 22 25 152 | A1 | 12/1973 |
| DE | 43 05 158 | A1 | 8/1994 |

(Continued)

*Primary Examiner* — Clark F. Dexter
(74) *Attorney, Agent, or Firm* — Browdy and Neimark, PLLC

(57) ABSTRACT

A cutting arrangement comprises a blade shaft (32) which is mounted for drivable rotation about a blade-shaft axis of rotation (31) and which has at least one circular blade (34); and a brush roll (16) which is disposed opposite the blade shaft (32) and mounted for rotation about a brush-roll axis of rotation (15); the brush roll (16) possessing shells (37) in the cross-sectional shape of a segment of a circle which are disposed on a roll core (17) and which have an outside (39) and an inside (40) that is turned towards the roll core (17), bristles that stand out from the outside (39), torque-transmission components (44, 45, 46) for transmitting torque from the roll core (17) to the shells (37), and fastening components (49, 51) for fixing the shells (37) to the roll core (17).

20 Claims, 15 Drawing Sheets

U.S. PATENT DOCUMENTS

| | | | | | |
|---|---|---|---|---|---|
| 3,942,210 | A | | 3/1976 | Clark | |
| 4,397,484 | A | * | 8/1983 | Miller | 285/81 |
| 4,661,031 | A | * | 4/1987 | Heine | 411/263 |
| 4,711,147 | A | * | 12/1987 | Dettelbach et al. | 83/863 |
| RE32,986 | E | * | 7/1989 | Dettelbach et al. | 83/863 |
| 5,134,913 | A | | 8/1992 | Schroeder | |
| 5,299,375 | A | * | 4/1994 | Thummel et al. | 42/115 |
| 5,378,051 | A | | 1/1995 | Kirkkala et al. | |
| 5,910,203 | A | * | 6/1999 | Hauser | 83/651.1 |
| 5,997,012 | A | * | 12/1999 | Brian | 279/43.5 |
| 6,796,761 | B2 | * | 9/2004 | Mizuno et al. | 411/386 |
| 2003/0000988 | A1 | | 1/2003 | Ruhland et al. | |

FOREIGN PATENT DOCUMENTS

| | | | |
|---|---|---|---|
| DE | 101 31 833 | A1 | 1/2003 |
| EP | 0 443 396 | B1 | 8/1991 |
| GB | 2 305 675 | A | 4/1997 |
| WO | WO 02/102558 | A1 | 12/2002 |

* cited by examiner

BRUSH CYLINDER

The invention relates to a cutting arrangement for producing cuts and/or slits in webs of corrugated board as well as a shell which is a constituent part of a corresponding cutting arrangement.

Webs of corrugated board are produced on corrugating machines and then cut to size. In doing so, longitudinal cuts are produced in pre-determined positions. EP 443 396 B1 describes, in a longitudinal cutting arrangement, to arrange the driven circular blades on one side of a web of corrugated board. A brush roll is located on the opposite side, which supports the corrugated board when the longitudinal cut is made and which the circular blade can simultaneously immerse into when the cut is made. During the production of longitudinal cuts, the bristles of the brush roll are subject to wear so that the entire brush roll must be replaced regularly. This is time-consuming and costly.

It is an object of the invention to embody a simplified cutting arrangement for webs of corrugated board.

This object is attained by the features of the claimed invention. The gist of the invention resides in that, in a cutting arrangement, the brush roll is formed by a cylindrical, rotatable roll core enveloped by shells of a cross-sectional shape of a segment of a circle, in particular half shells. The shells have bristles outside. On the inside, means are provided, enabling the shells to be non-rotarily joined to the roll core. The shells further comprise means for the shells to be fixed to the roll core. This can be put into practice by the shells being joined to each other or by them being fixed to the roll core.

Further advantageous embodiments of the invention will become apparent from the claimed invention.

Additional features and details of the invention will become apparent from the ensuing description of five exemplary embodiments, taken in conjunction with the drawing, in which.

Figure 1:
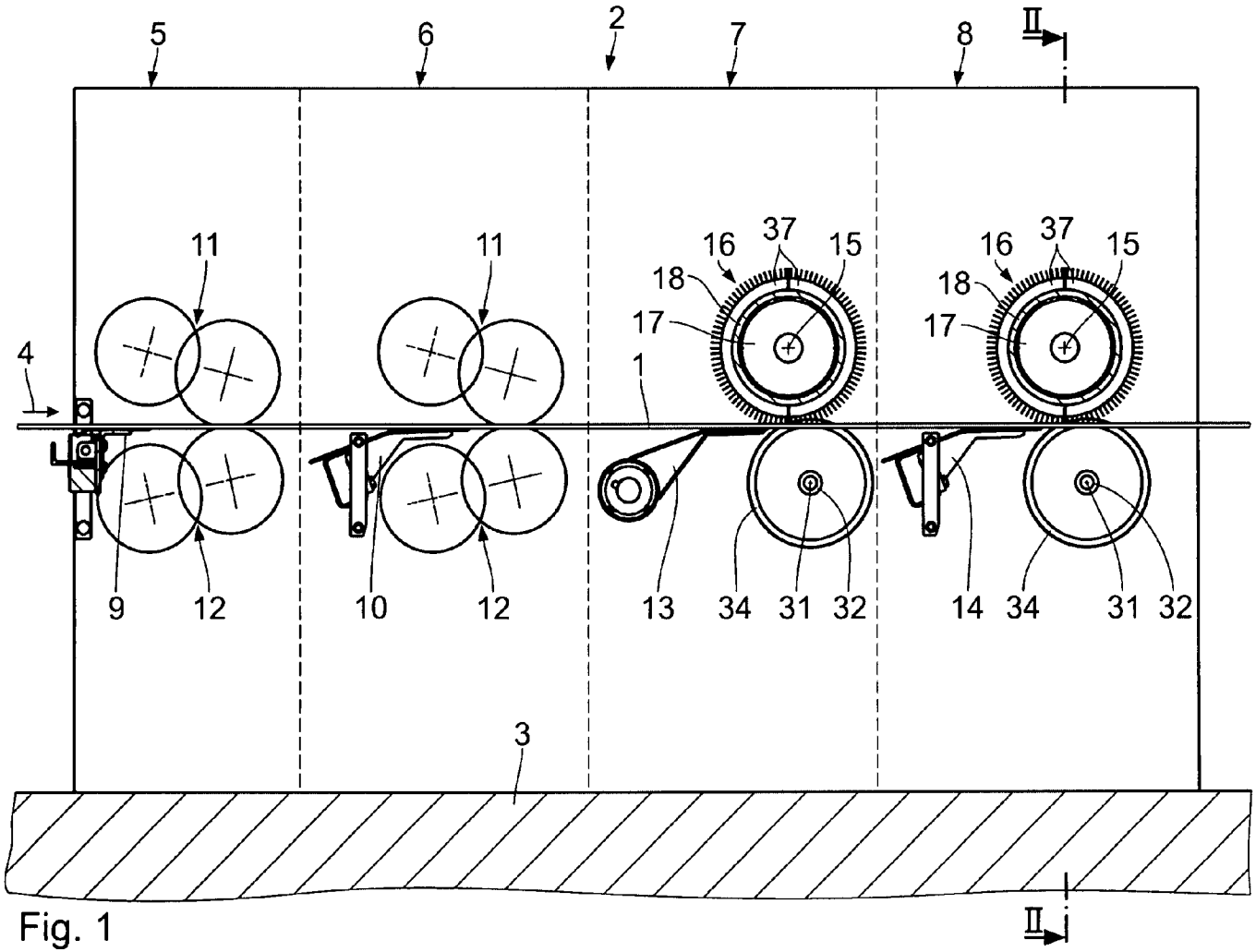
FIG. 1 is a cross-sectional view of a first exemplary embodiment of a cutting arrangement according to the invention.
Figure 2:
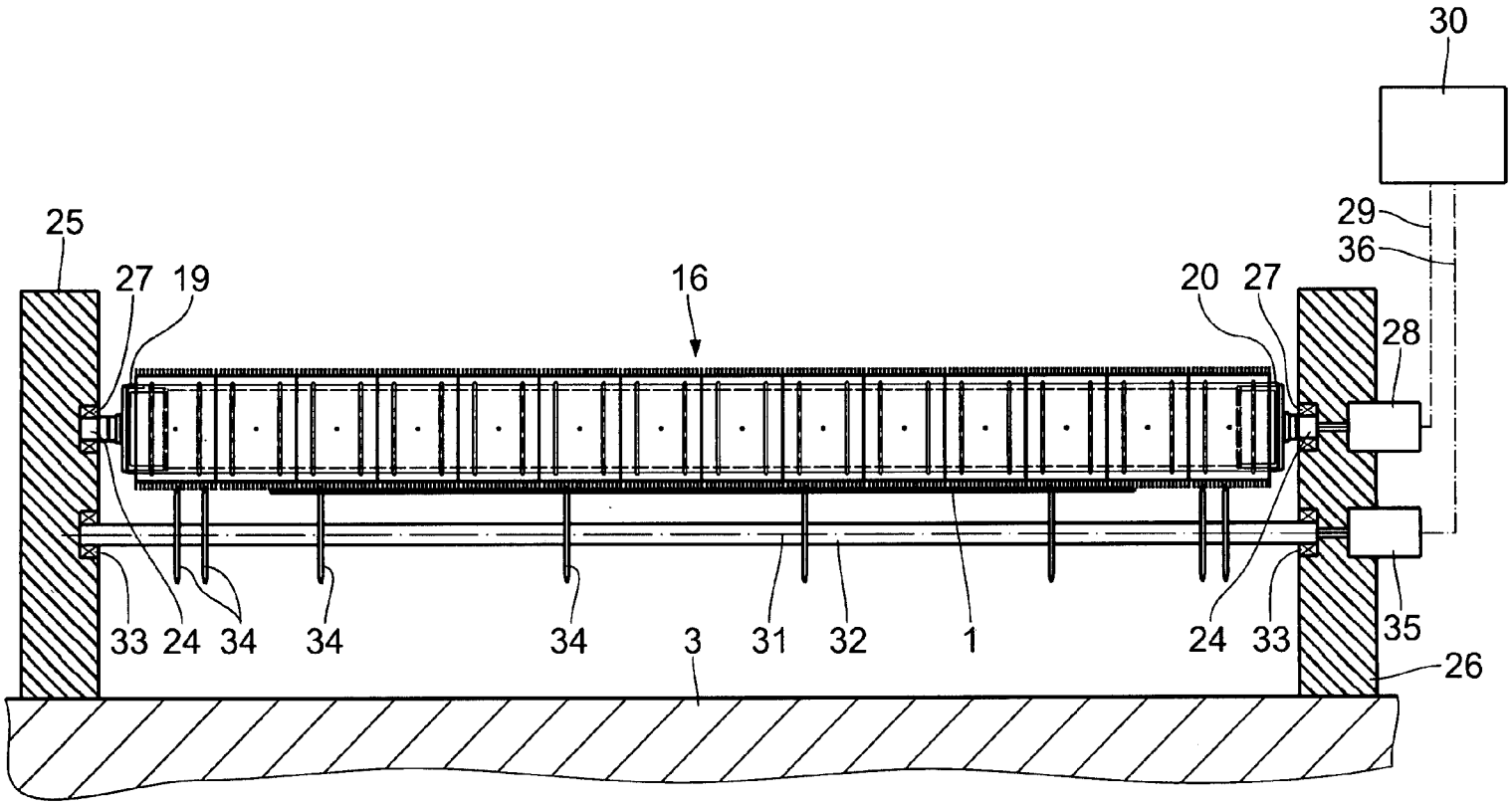
FIG. 2 is a cross-sectional view on the line II-II of FIG. 1.
Figure 3:
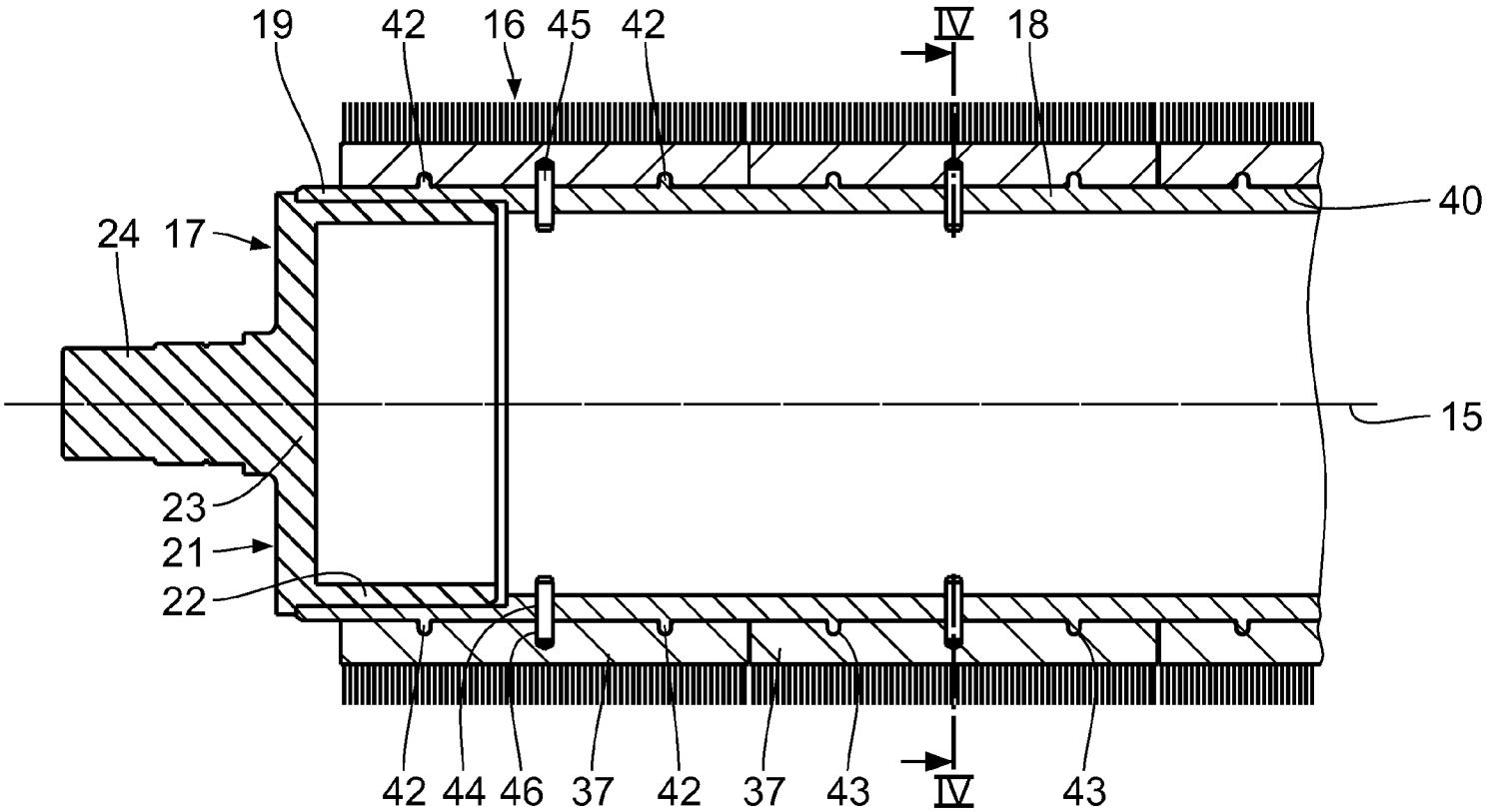
FIG. 3 is an illustration of a detail of the cross section according to FIG. 2.
Figure 4:
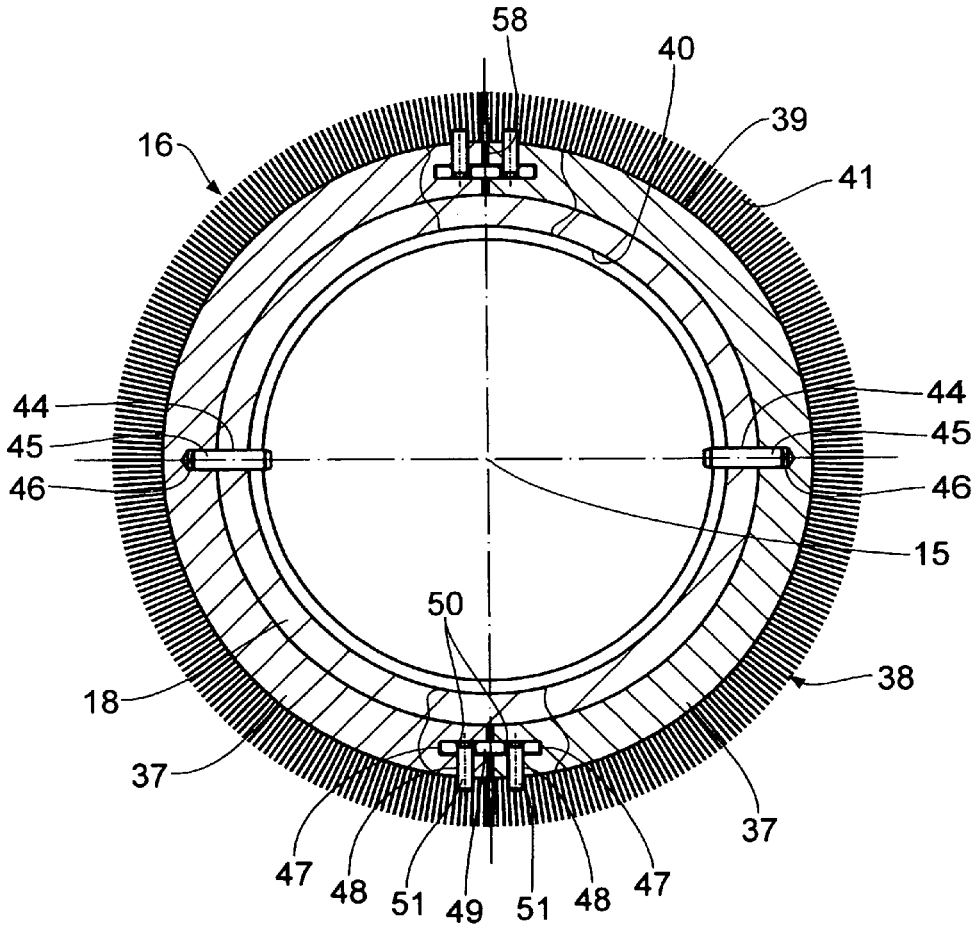
FIG. 4 is a cross-sectional view, rotated by 90°, on the line IV-IV of FIG. 3.

A corrugating plant comprises a generally known machine for the production of webs of single-faced corrugated board which is known, for example, from EP 0 687 552 A (corresponding to U.S. Pat. No. 5,632,850), DE 195 36 007 A (corresponding to GB 2,305,675 A) or DE 43 05 158 A1, which are referred to for details. Possibly, the web of single-faced corrugated board is lined with a liner, or with another or several other webs of single-faced corrugated board and a liner. The units for producing a corresponding web of corrugated board 1, seen in FIG. 1, are on the left i.e., upstream of a longitudinal cutter/scorer station 2 that is illustrated in FIG. 1 and supports itself on a bottom 3 of the machine. The web of corrugated board 1 is conveyed in a conveying direction 4. The longitudinal cutter/scorer station 2 comprises four units in the direction 4, namely a first scorer unit 5, a second scorer unit 6, a first cutter 7 and a second cutter 8. The scorer units 5 and 6 are identical apart from two guiding tables 9, 10; they comprise top scoring tools 11 and bottom scoring tools 12 which cooperate for corrugating the medium board. The scorer units 5 and 6 are known for example from DE 197 54 799 A (corresponding to U.S. Pat. No. 6,071,222) and DE 101 31 833 A. Two scorer units 5, 6 and two cutters 7 and 8 are provided at a time so that, upon format change of the sheets of corrugated board to be cut, a unit can be moved into the new position while the other unit is still in engagement with the web of corrugated board 1. The cutters 7, 8 are disposed on a distance of travel or path of travel of a web of corrugated board 1 in a corrugating plant.

The cutters 7, 8, which are identical apart from the guiding tables 13, 14 that the web of corrugated board 1 is guided on, will be described in detail below. Each cutter 7 and 8, respectively, comprises a brush roll 16 which is disposed above the web of corrugated board 1 and mounted for rotation about an axis of rotation 15. The brush roll 16 has a roll core 17. The roll core 17 is comprised of a cylindrical core sleeve 18, which is hollow inside, as well as roll flanges 21 that are fixed to both ends 19, 20 thereof. The roll flanges 21 have an annular cylindrical projection 22 which projects into the sleeve 18 and is joined to the sleeve 18. On the outside, the projection 22 is closed by a bottom 23, from which a journal 24 stands out centrally.

The brush roll 16 is bilaterally mounted on two props 25, 26 which support themselves on the bottom 3 and participate in the construction of a machine frame; the journals 24 are housed in associated sliding bearings 27 of the props 25 and 26, respectively. The brush roll 16 is rotarily drivable by way of a motor 28 which is fixed to the prop 26. The motor 28 is connected via a control line 29 to a control unit 30.

A blade shaft 32, which is mounted for rotation about an axis of rotation 31, is located below the brush roll 16 and below the web of corrugated board 1. By its ends the blade shaft 32 lodges in corresponding sliding bearings 33 of the props 25 and 26. The axes of rotation 15 and 31 are parallel to one another. The axis of rotation 31 is located slightly downstream of the axis of rotation 15 in the conveying direction 4. Numerous circular blade disks 34 are non-rotarily mounted on the blade shaft 32, rotating together with the blade shaft 32. The circular blades 34 are displaceable on the blade shaft 32 by means of a generally known displacement unit (not shown). The blade shaft 32 is connected for torque transmission to a motor 35 which is fixed to the prop 26. The motor 35 is connected via a control line 36 to the control unit 30.

Figure 5:
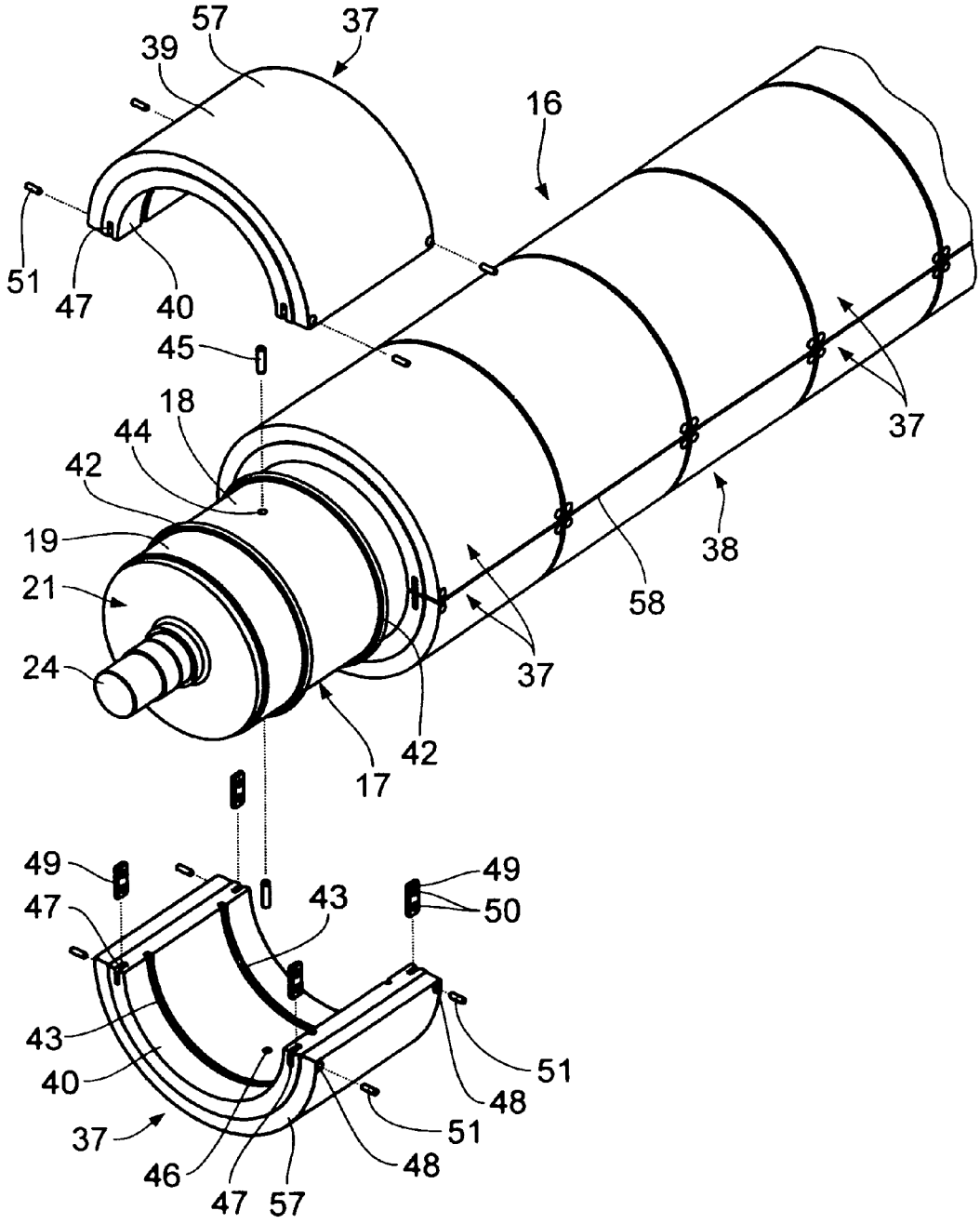
FIG. 5 is an exploded view of a brush roll according to FIG. 2 without brushes.

A brush sleeve 38, which is composed of individual shells 37, fourteen pairs of two shells 37 at a time in the present case, is mounted on the roll core 17. The shells 37 have the cross-sectional shape of a segment of an arc of a circle. In the present case, this is a semi-arc of a circle which is why the shells 37 are also called half shells. Two associated shells 37 abut along two straight parallel gaps 58. It is just as well possible that more than two shells are provided along the periphery of the roll core 17, for example three shells each of an angle at center of 120°. The shells 37 have a basic structure 57 in the shape of a sector of a circular cylinder, having an outside 39 turned outwards and an inside 40 turned towards the roll core 17. The shells 37 consist of plastic material and have substantially the same thickness peripherally. Bunches of bristles 41, which are joined to the shell 37 and stand out radially, are located on the outside of each shell 37. Each bunch of bristles 41 is comprised of individual bristles (not shown in detail). A typical bunch of bristles 41 has a cross section of approximately 5.5 mm at its root and expands conically in the radial direction. Each individual bristle has for example a diameter of 0.6 mm. The conical expansion of the bunches of bristles produces a substantially uniform distribution of bristle tips on the outside of the brush roll 16. The bunches of bristles 41 are disposed in rows which are parallel to the axis of rotation 15, with the rows being displaced one in relation to the other. Details of this can be seen in FIG. 13. The bristles 41 of the bunches are flexible, consisting for example of polyamide. Full-face cover of the outside 39 by the bunch of bristles 41 is provided. In the present case, the bunch of bristles 41 has a length of approximately 20 mm. Of course, other lengths of bristles can be used, corresponding on the dimensions of the circular blades 34 and the brush roll 16. For simplification, FIG. 5 shows the shells 37 without the bunches of bristles 41. The present application uses the term brush roll in the widest sense as any roll suitable of supporting the web of corrugated board during a cutting job and which the circular blade can immerse into during the cutting job. Consequently, the term brush roll also implies rolls that have a soft surface of, for example, rubber.

Encircling, annular ribs 42 are provided on the roll-core sleeve 18; they are spaced apart axially and project radially. The inside 40 of the shell 37 is provided with corresponding semi-circular ring grooves 43 which the ribs 42 engage with. Each shell 37 is provided with two ring grooves 43. The positive inter-engagement of the ribs 42 and the ring grooves 43 fixes the shells 37 on the roll core 17 in the axial direction i.e., along the axis of rotation 31. For tangentially fixing the shells 37 on the roll core 17 i.e., for fixation in the peripheral direction and for torque transmission, the roll core 17 is provided with externally open holes 44, each of which accommodating a retaining pin 45 which, after being inserted in the hole 44, projects radially from the roll core 17. In the present case, a retaining pin 45 is provided for each shell 37. Consequently, two retaining pins 45 are opposite one another in relation to the axis 15. The inside 40 of each shell 37 is provided with an inwardly open blind hole 46 which a respective retaining pin 45 engages with, retaining the shell 37 in the peripheral direction. The retaining pin 45 thus works as a torque-transmission means, transmitting torque from the roll core 17 to the shells 37. Other than by positive fit, the torque-transmission means can also be produced by frictional engagement between the roll core 17 and the shells 37. In this case, the pin 45 is not necessary. At its front and rear end in the axial direction, each shell 37 comprises slits 47 which are open in the peripheral direction and which blind holes 48 mouth into that extend radially from the outside inwards. The slits 47 are located at the ends of the shell 37 on the peripheral side, in the present case being displaced from one another by 180°. Joining plates 49 are provided, each having two holes 50. For a first shell 37 to be joined to a second shell 37 opposite the first, a plate 49 is inserted halfway into the slit 47 and secured by a pin 51 which is pushed from outside into the blind hole 48. The other half of the plate 49 is inserted into the opposite slit 47 of the other shell 37, where it is equally secured by a pin 51. As seen in FIG. 5, joining two opposed shells 37 takes place at both axial ends of the shell 37 and on both sides so that, as shown in FIG. 5, a total of four plates 49 is needed for the assembly. Flexible elements such as springs (not shown) may be used instead of plates 49; they ensure that the two opposite shells 37 that must be united are pre-loaded one in relation to the other. In this way, there will be no play between the two shells 37 even after prolonged operation, both being pulled towards one another by the spring element.

The following is a description of the operation of the cutters 7, 8 and of the replacement of the shells 37. If longitudinal incisions are to be made in certain positions in a web of corrugated board 1, the circular blades 34 are moved to the corresponding transverse positions in one of the two cutters 7 and 8, respectively, and then immersed into the web of corrugated board 1. In the process, the circular blade 34 passes through the web of corrugated board 1, ensuring that the web of corrugated board 1 is completely severed. The web of corrugated board 1 is supported from above by the bunch of bristles 41 of the brush roll 16 so that it is not able to escape. In doing so, the bunch of bristles 41 is compressed flexibly. In the present case, the circular knife 34 immerses by approximately 5 mm into the bristles of a length of approximately 20 mm. Advantages of the support of the web of corrugated board 1 by bristles reside in that the circular blades 34 may cut in any transverse positions. The transverse positions of the blades 34 depend on how the sheets of corrugated board are set to be cut. Consequently, the blades 34 are never blocked by a corresponding rigid stop. If a change of format must be made, the inactive blades are moved into a new position and immersed into the web of corrugated board 1 while the still active blades are withdrawn from the web of corrugated board 1.

By cooperation of the blades 34 with the bunch of bristles 41, the bristles wear off, being subject to increasing abrasion. After a certain time, the bristles must be replaced. For this purpose, the roll core 17 can remain in the associated bearings 27. Unlike the prior art solutions, the entire brush roll does not have to be removed from the bearings for replacement of the brush. The brush sleeve 38, which consists of individual shells 37, is removed by the pins 51 being pulled out, as a result of which respectively opposite shells 37 are detachable from the roll core 17, as illustrated in the exploded view of FIG. 5. This applies to all the shells 37. Then fresh shells 37 with fresh bristles are mounted in precisely the reverse way. This means that one shell 37 at a time is placed on the roll core 17 so that the retaining pin 45 rests in the holes 44 and 46. The associated second shell 37 is fixed to the first by the plates 49 and the pins 51. Replacement of the shells 37 and thus of the entire brush sleeve 38 is rendered possible in a simple way and at a low cost without the roll core 17 having to be removed from its bearings and the entire surroundings.

Figure 6:
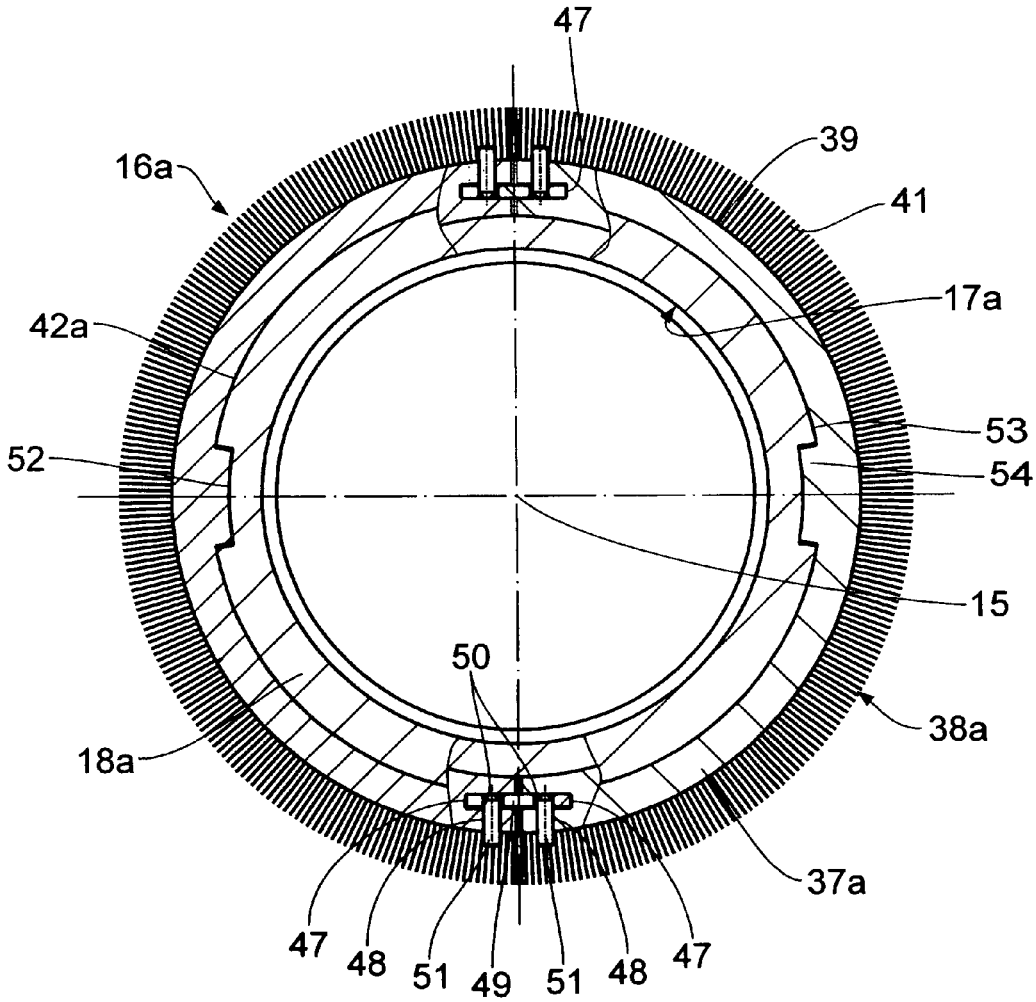
FIG. 6 is an illustration, corresponding to FIG. 4, of a brush roll according to a second embodiment.
Figure 7:
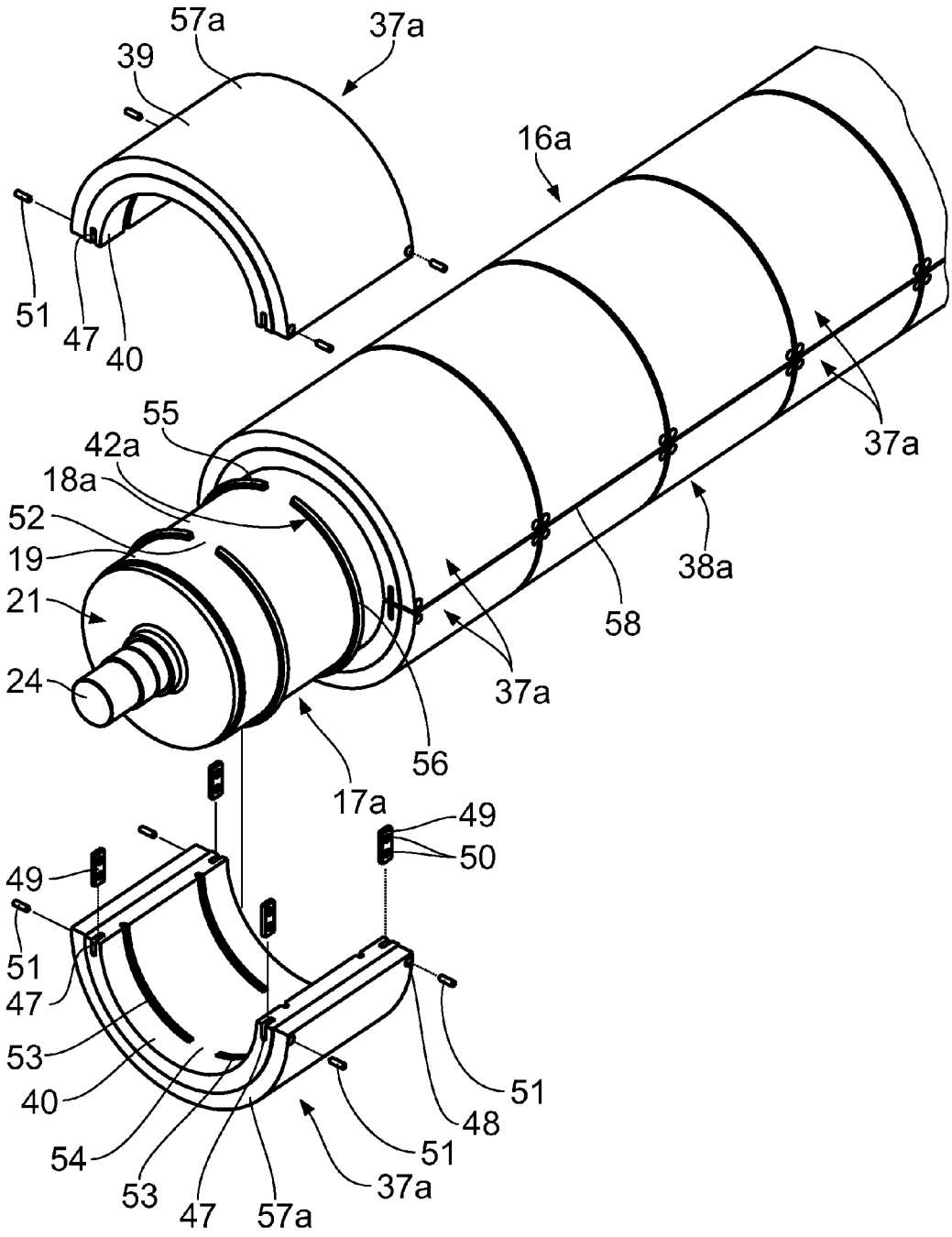
FIG. 7 is a view, corresponding to FIG. 5, of the brush roll according to the second embodiment.

A second exemplary embodiment of the invention is going to be described below, taken in conjunction with FIGS. 6 and 7. Constructionally identical parts have the same reference numerals as in the first embodiment, the description of which is referred to. Parts that differ constructionally, but are functionally identical have the same reference numerals with an "a" annexed. The substantial difference from the first embodiment resides in that, as opposed to the first embodiment, the ribs 42*a*, which are disposed on the cylindrical core sleeve 18*a* of the roll core 17*a*, do not encircle entirely, but have discontinuities 52 on two opposite sides where no rib 42*a* is disposed. The ribs 42*a* therefore consist of two sections 55, 56 which are not connected with one another and have an angle at center of less than 180°, in particular approximately 170°. Correspondingly, ring groove sections 53 of an angle at center of less than 90° are provided on the inside 40 of the shell 37*a*. A rib 54, which projects towards the bottom of the grooves 53, remains between two ring-groove sections 53 that are located on the same periphery. The discontinued ribs 42*a* engage with the ring-groove sections 53. This applies in particular to the remaining rib 54 which engages with the discontinuity of the rib 42*a*. Tangential fixing of each shell 37*a* is obtained in this way so that torque transmission is possible from the roll core 17*a* to the brush sleeve 38*a*. As opposed to the first embodiment, retaining pins 45 are not necessary. Replacement of the brush sleeve 38*a* takes place as in the first embodiment.

Figure 8:
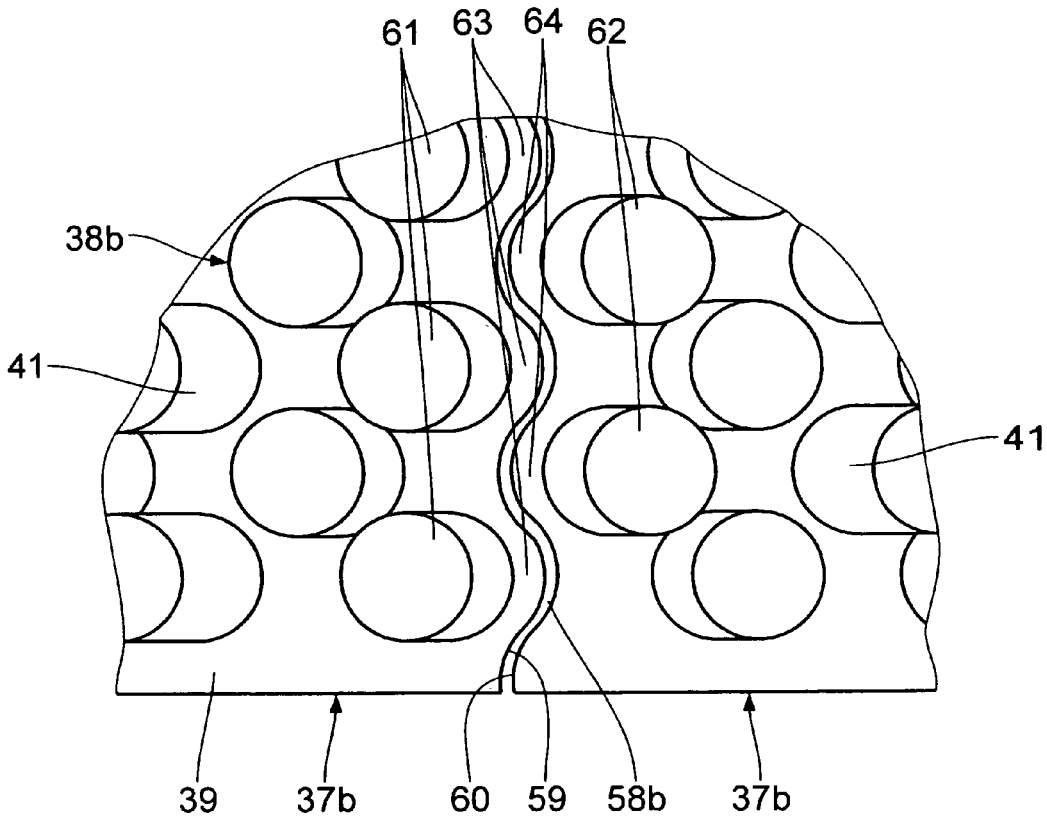
FIG. 8 is an enlarged plan view of a detail of a brush roll according to a third embodiment.

A third exemplary embodiment of the invention is going to be described below, taken in conjunction with FIG. 8. Constructionally identical parts have the same reference numerals as in the first embodiment, the description of which is referred to. Parts that differ constructionally, but are functionally identical have the same reference numerals with a "b" annexed. As in the first embodiment, two 180°-shells 37*b* are provided on a level of the brush roll 16; they envelop the roll core 17 entirely. As in the first embodiment, the bunch of bristles 41 projects normally radially from the axis 15. Unlike the first embodiment, two associated shells do not abut along a straight parallel gap 58. Rather, provision is made for a meandering, serpentine or zigzagging gap 58*b*. The faces 59, 60 of the shells 37*b* which define the gap 58*b* are such that they interengage alternatingly or in the way of fingers. The bunches of bristles 61 and 62, which are disposed in the vicinity of the faces 59, 60, are located in the vicinity of the respective projections 63 and 64 of the faces 59 and 60. In this way, the distance between directly adjacent bunches of bristles 61 and 62 of various shells 37*b* is reduced upon assembly of the shells 37*b* so that the bunches of bristles 61 and 62 cover the gap 58*b* as perfectly as possible and, upon rotation of the brush roll 16, provide for as uniform as possible a supporting behaviour of the web of corrugated board 1. Consequently, as for the support of the web of corrugated board 1, it is considerably less important whether the bunch of bristles 41 is located somewhere on the surface of the shell 37*b* or in proximity to the gap 58*b*. In particular, each projection 63 and 64 is allocated its proper bunch of bristles 61 and 62 which is located at least in part on the projection. This means that the edge of the bunch of bristles 61 that is turned towards the face 59 projects from the adjacent setbacks of the same face 59. By placing the bunch of bristles 61 at least in part on the projection 63, the distance from the two defining bunches of bristles 62 of the adjoining shell can be minimized; a constant minimum distance of the edge from the face 59 can be kept so that fixing the bunch of bristles 61 to the backing is not impeded.

A fourth exemplary embodiment of the invention is going to be described below, taken in conjunction with FIGS. 9 to 12. Constructionally identical parts have the same reference numerals as in the first embodiment, the description of which is referred to. Parts that differ constructionally, but are functionally identical have the same reference numerals with a "c" annexed. The difference from the first embodiment resides in that the bunches of bristles 61*c* and 62*c* which adjoin the gap 58 between the two half shells 37*c* do not extend radially outwards in relation to the axis 15, but incline by an angle b towards the gap 58, with $1° \leqq b \leqq 15°$, in particular $2° \leqq b \leqq 10°$, and in particular $b \approx 5°$ applying. The bristles that adjoin the bunches of bristles 61*c* and 62*c* can incline towards the gap 58 too. The inclined arrangement described above can apply to the entire bunches of bristles as well as to individual bristles. The resultant advantage consists in improved cover of the gap 58 as in the third embodiment, the function of the brush roll 16 thus being equally perfect at any point of the periphery.

Since the shells 37 do not only abut tangentially in the vicinity of the gap 58, but also in the axial direction i.e., along the axis of rotation 15, the bristles 65 there too incline outwards by an angle b in the vicinity of the axial faces 66. In this way, the gaps between the faces 66 of two axially successive shells 37 are covered more perfectly.

Figure 13:
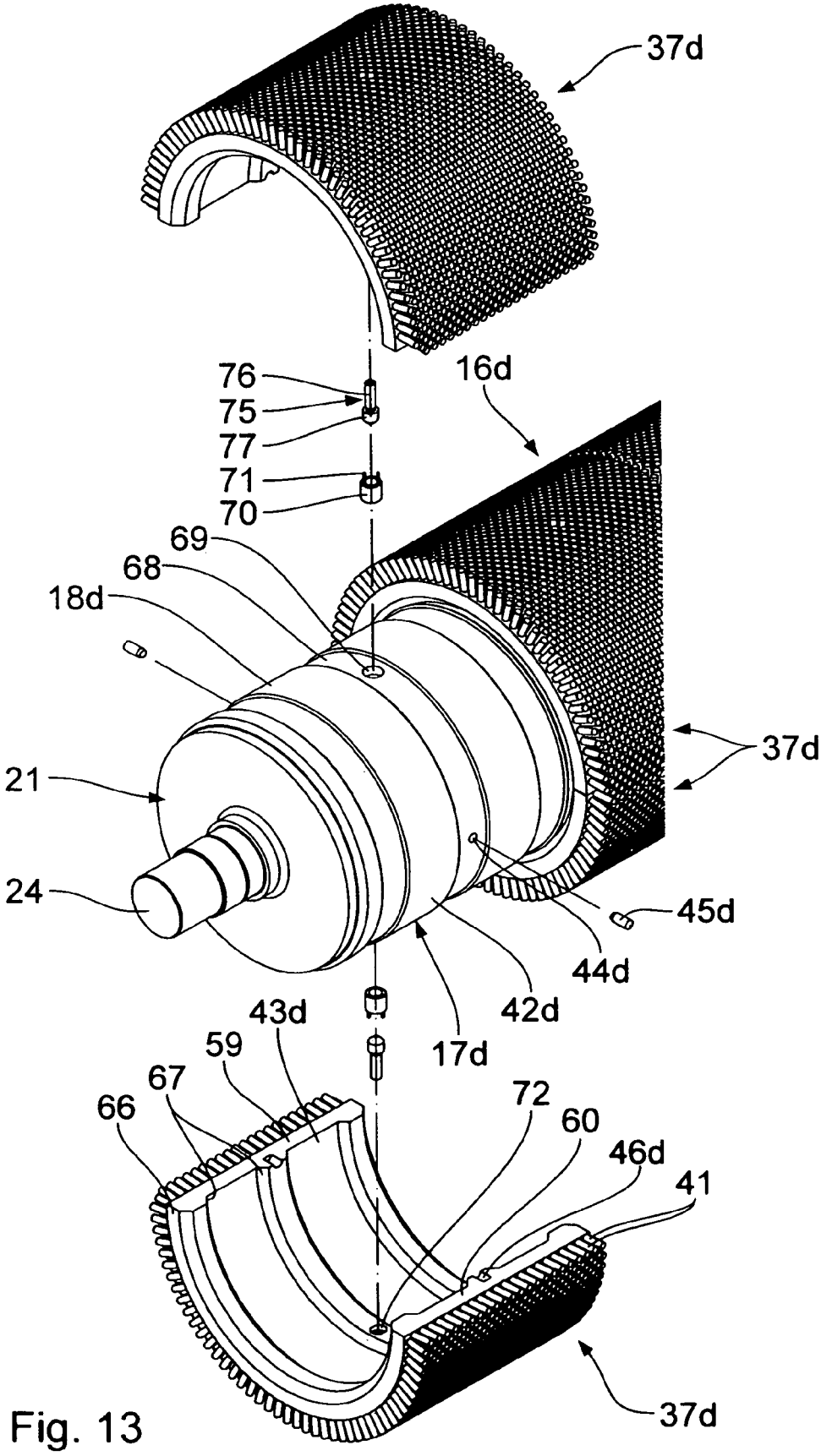
FIG. 13 is an exploded view of a brush roll according to a fifth embodiment.
Figure 14:
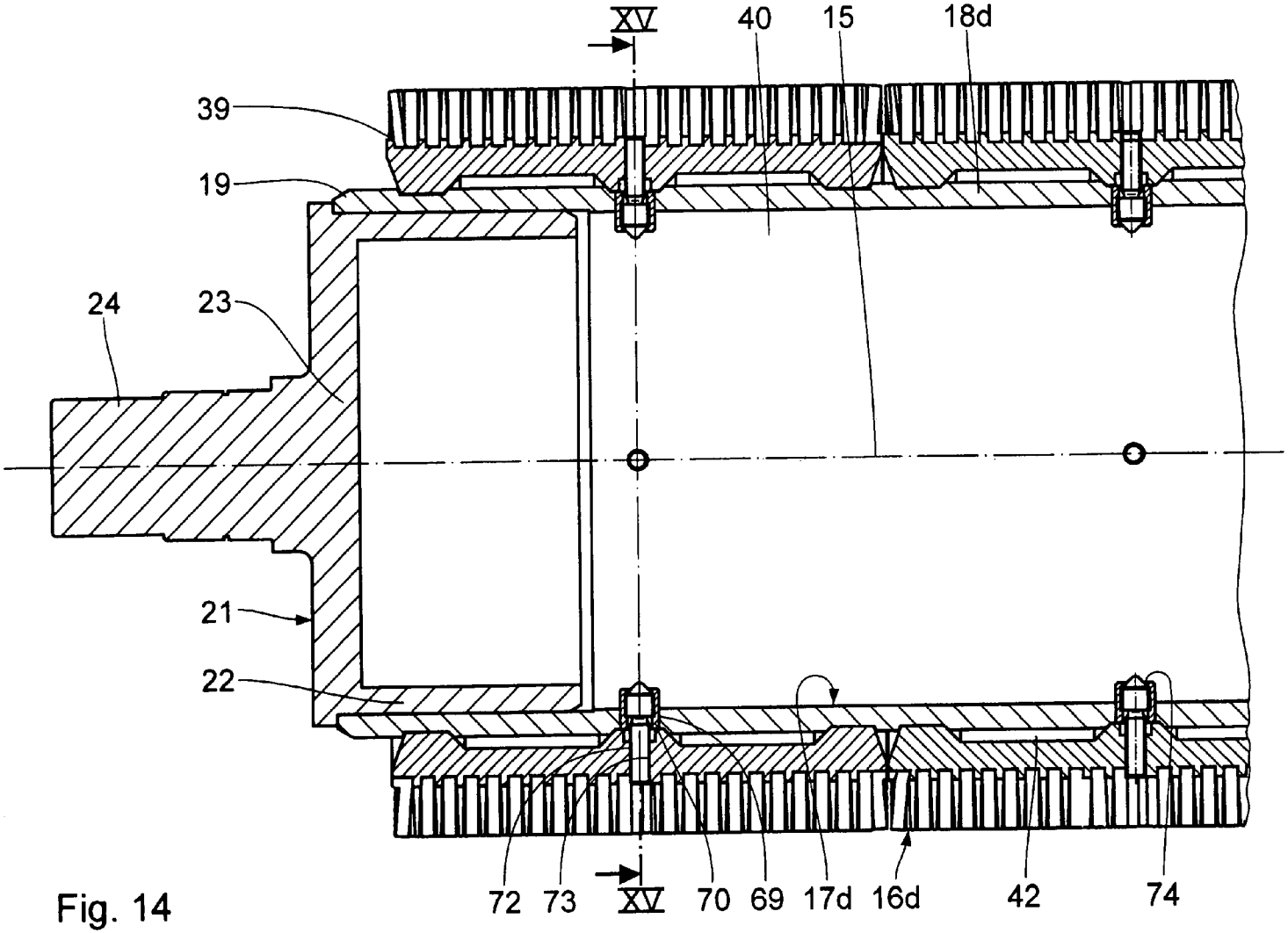
FIG. 14 is a longitudinal sectional view of the brush roll according to FIG. 13.
Figure 15:
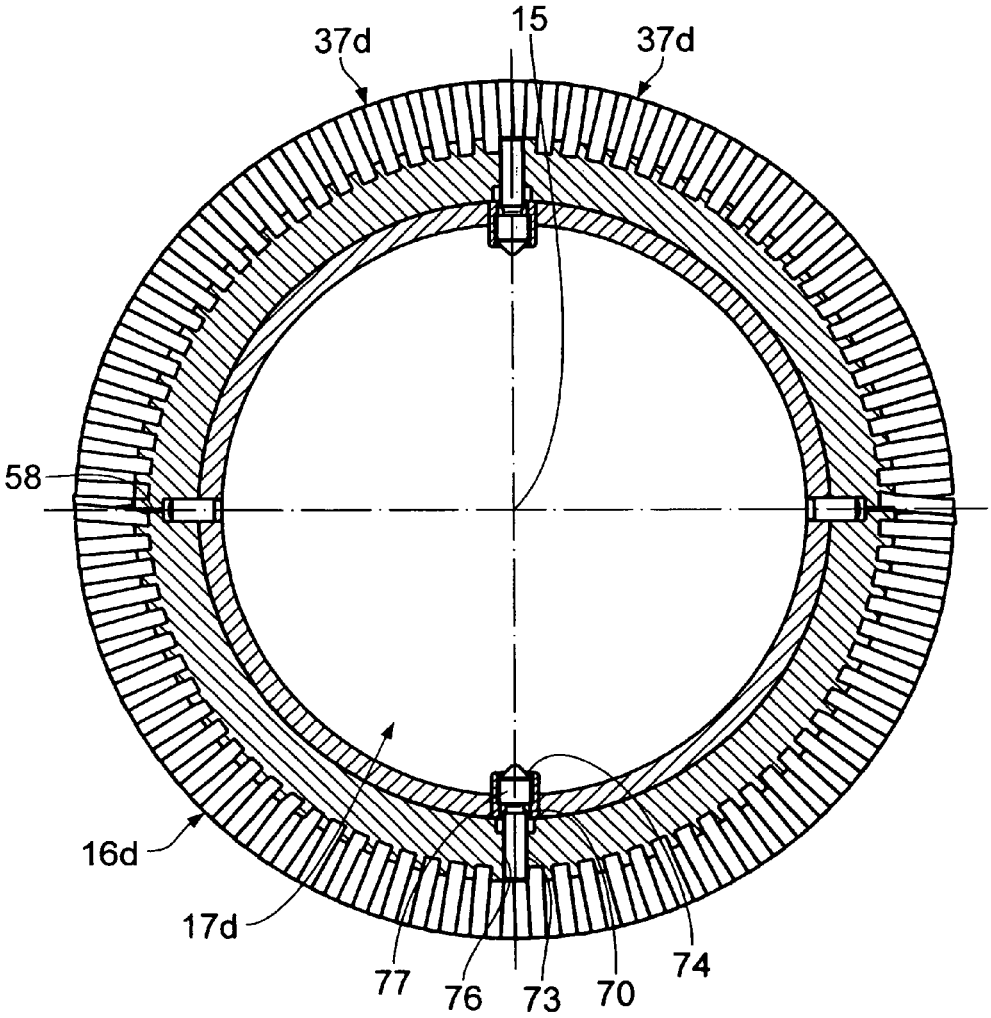
FIG. 15 is a cross-sectional view on the line XV-XV of FIG. 14.

A fifth exemplary embodiment of the invention is going to be described below, taken in conjunction with FIGS. 13 to 15. Constructionally identical parts have the same reference numerals as in the first embodiment, the description of which is referred to. Parts that differ constructionally, but are functionally identical have the same reference numerals with a "d" annexed. The substantial difference from the first embodiment resides in the way how the shells 37*d* of the brush roll 16*d* are fixed to the roll core 17*d*. As in the first embodiment, the cylindrical core sleeve 18*d* of the roll core 17*d* comprises radially projecting annular ribs 42*d* which engage with associated ring grooves 43*d* in the half shells 37*d*, in this way fixing the half shells 37*d* in the axial direction. The axial edges 67 of the ring grooves 43*d* are skewed so that removal of the plastic shell 37*d* from a mold is facilitated. However, it is fundamentally possible to provide edges 67 which are perpendicular to the axis 15. A corresponding setback in the form of a ring groove 68 is provided between two annular ribs 42*d* on the roll core 17*d*. This setback comprises two holes 44*d* which are disposed on diametrically opposed sides and into which pins 45*d* are inserted for example by press fit or screwing. The two faces 59, 60 of each half shell 37*d* centrally comprise a half blind hole which is externally open halfway. The half blind holes 46*d* of two adjacent shells 37*d* enclose the pin 45*d* when assembled. A hole 69 is provided centrally between two axially level, opposite pins 45*d*, i.e., displaced by 90° in relation thereto. A threaded insert 70 is screwed into this hole 69; it has an external thread as well as an internal thread. The threaded insert 70 is a standard component. It has spikes 71 which project radially outwards and which, after the threaded insert 70 has been screwed completely into the hole 69, are driven in a direction towards the axis 15. The spikes 71 destroy a part of the internal thread, located in the hole 69, of the aluminum roll core 17*d*, whereby the threaded insert 70 is permanently fixed in the hole 69. Centrally between the faces 59 and 60 and also centrally in the axial direction, each shell 37*d* has a through hole 72. The hole 72 has an internal thread 73, for example of the type M12. It is of essential importance that the pitch of the internal thread 74 inside the threaded insert 70 exceeds the pitch of the internal thread 73 inside the half shell 37*d*. A threaded pin 75 with external threads is provided which fits the two threads 73, 74, the external threads including a distal thread portion 76 that fits the internal thread 73 as well as a proximal thread portion 77 of larger diameter that fits the internal thread 74.

Figure 9:
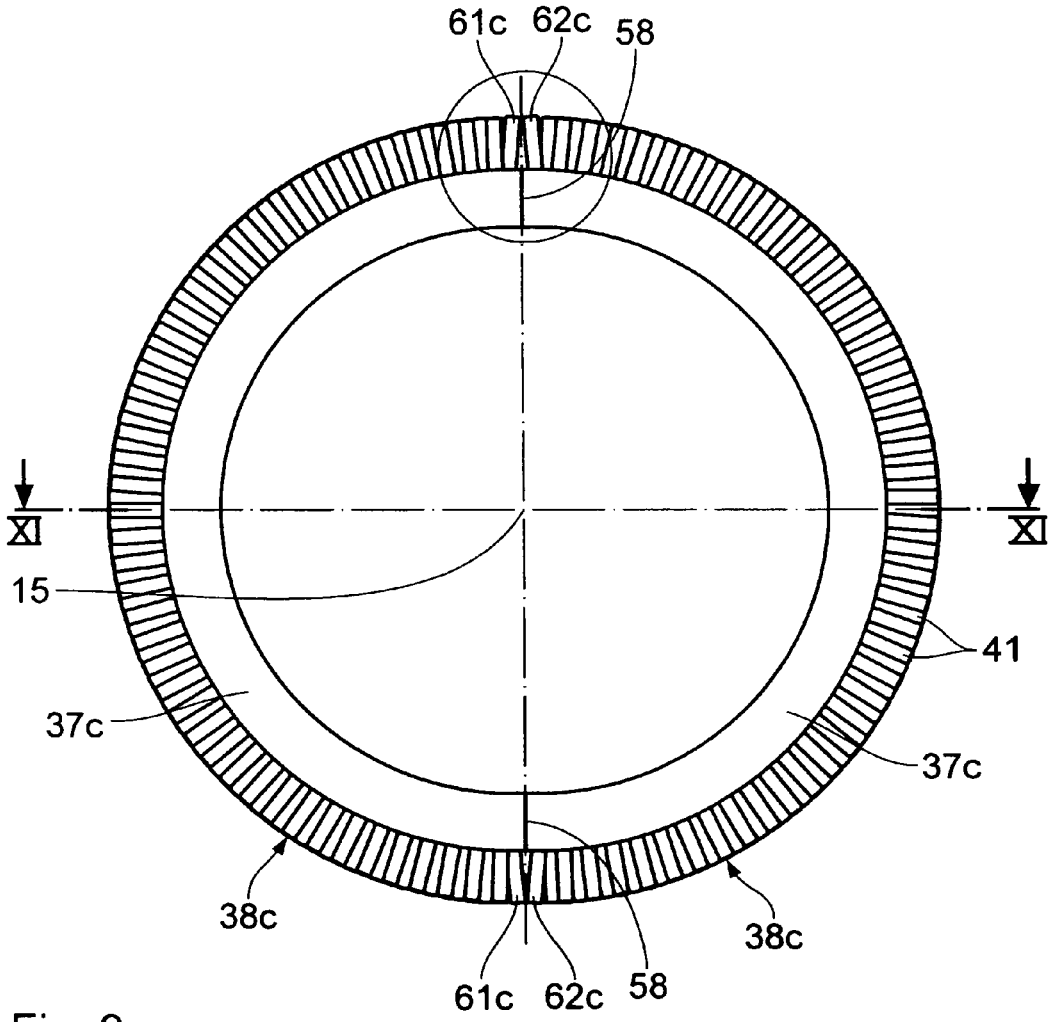
FIG. 9 is a cross-sectional view of a brush roll according to a fourth embodiment.
Figure 10:
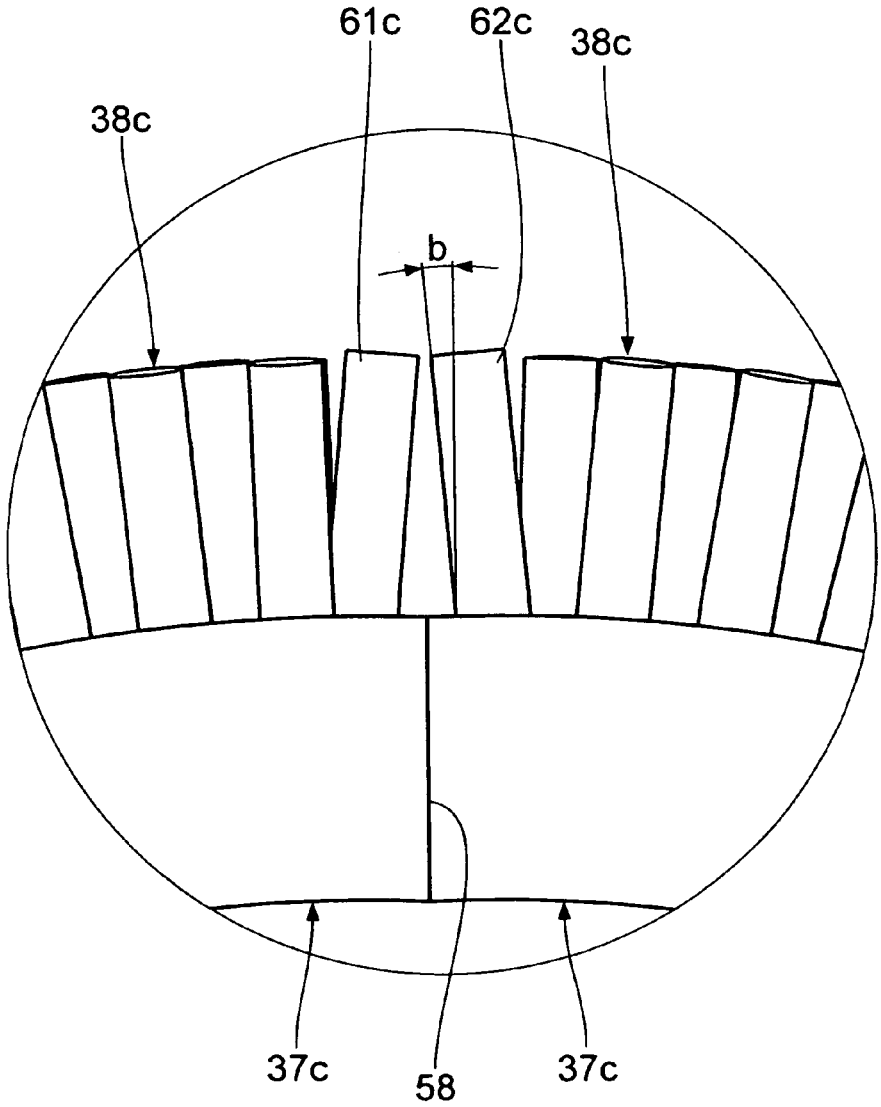
FIG. 10 is an enlarged view of details of the bristles of the brush roll according to FIG. 9.
Figure 11:
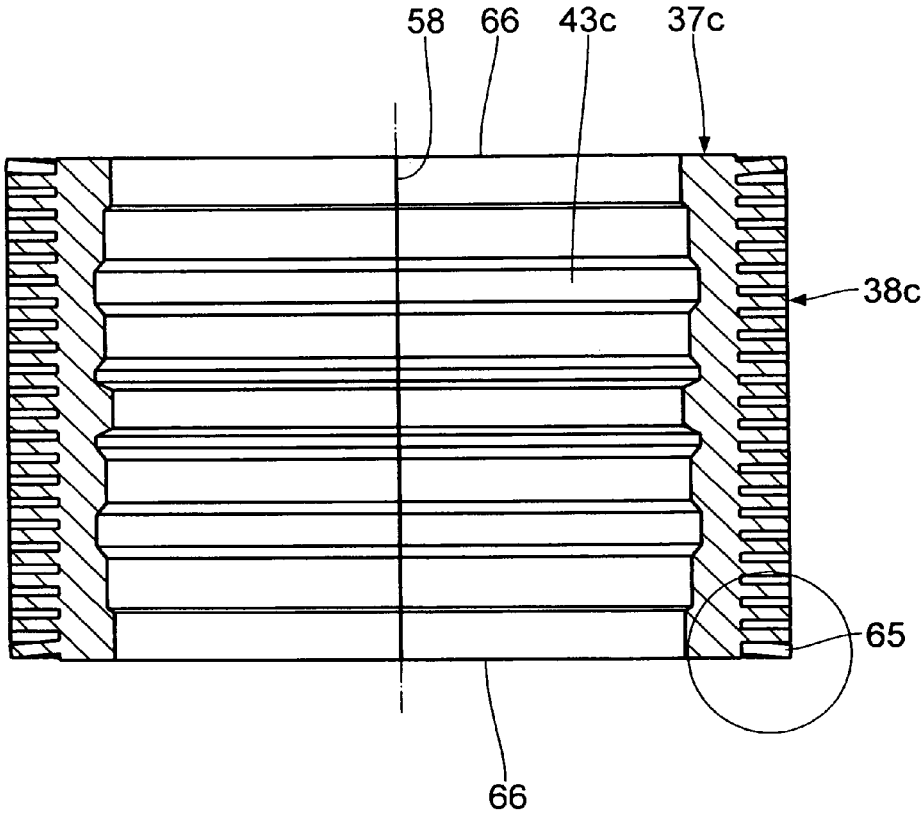
FIG. 11 is a sectional view on the line XI-XI of FIG. 9.
Figure 12:
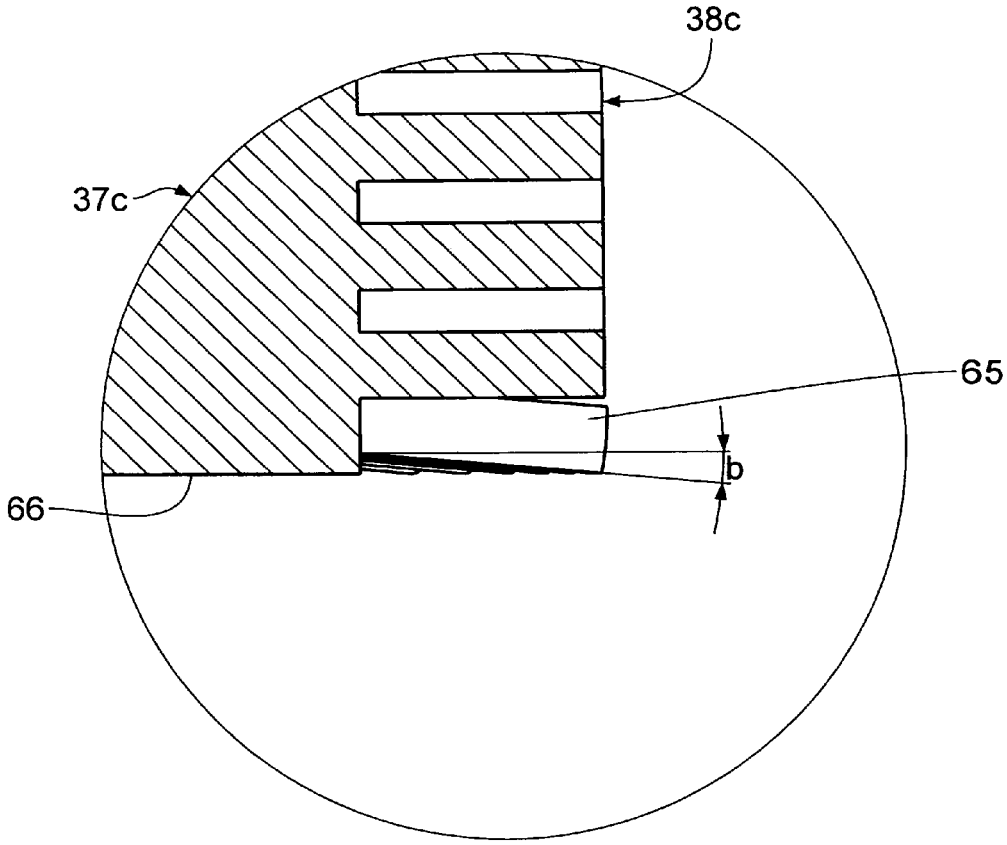
FIG. 12 is an enlarged view of details of the bristles of the brush roll according to FIG. 11.

The bunches of bristles 41 incline towards each other in the vicinity of the gap 58 by an angle $b>0°$, as described in the embodiment according to FIG. 9. This may also apply to the bristles in the vicinity of the axial faces 66.

The assembly of the shells 37*d* will be described below. At first the pins 45*d* are secured in the associated holes 44*d*. Then the threaded pin 75 is screwed by the distal thread portion 76 into the hole 72 in the shell 37*d* until it stops. Then the half shell 37*d* is placed on the roll core 17*d*, the pins 45*d* engaging with the halfway open blind holes 46*d* and fixing the shells 37*d* in a certain position on the core 17*d*. Afterwards the threaded pin 75, the outer end of which has a hexagon socket, is screwed from outside through the hole 72 with the proximal thread portion 77 into the internal thread 74 of the threaded insert 70 by an associated implement. With the pitch of the internal thread 74 inside the threaded insert 70 exceeding the pitch of the thread 73 inside the shell 37*d*, the threaded pin 75 is driven per revolution faster into the roll core 17*d* than it is screwed out of the shell 37*d*. In this way the shell 37*d* is fastened on the roll core 17*d*. So as to ensure that the threaded pin 75 is driven into a sufficient number of flights in the threaded insert 70, a gap must remain in the radial direction in the vicinity of the two holes 69 and 72 when the half shell 37*d* is placed on the roll core 17*d*. This gap is closed when the threaded pin 75 is screwed in. Disassembly of the shell 37*d* is correspondingly simple.

The invention claimed is:

1. A cutting arrangement which is disposed on a path of travel of a web of corrugated board that is continuously produced by a corrugating machine, the cutting arrangement comprising:

a. a blade shaft which is mounted on a blade-shaft axis of rotation for drivable rotation and which comprises at least one circular blade thereon; and b. a brush roll, which is disposed opposite to the blade shaft and mounted for rotation about an axis of rotation, for supporting the web of corrugated board which passes between the circular blade and the brush roll when the web of corrugated board is cut by the at least one circular blade;

c. the brush roll comprising shells which are disposed on a roll core and have a cross-sectional shape of a segment of a circle, wherein each shell has i. an outside and an inside, the inside faces towards the roll core;

ii. bristles which stand out from the outside;

iii. torque-transmission means for transmitting torque from the roll core to the shells; and iv. fastening means for fixing the shells to the roll core;

d. wherein threaded holes are radially provided in the roll core and on the inside of the shells, respectively accommodating the fastening means for non-rotary connection of the shells with the roll core;

e. wherein the fastening means comprises a fastening pin, and the fastening pin comprises two threaded portions of different pitches;

f. wherein a first of the threaded portions of the fastening pin is engaged with the threaded hole on the shell, and a second of the threaded portions of the fastening pin is engaged with the threaded hole on the roll core, and the second threaded portion of the fastening pin has a larger pitch than the pitch of the first threaded portion of the fastening pin; and g. wherein the second threaded portion of the fastening pin is of a larger diameter than the first threaded portion of the fastening pin.

2. A cutting arrangement according to claim 1, wherein the shells are half-shells.

3. A cutting arrangement according to claim 1, wherein the shells form a closed brush sleeve on the roll core.

4. A cutting arrangement according to claim 1, wherein annular ribs are provided on the roll core, and the annular ribs project radially at least along part of a periphery of the roll core.

5. A cutting arrangement according to claim 4, wherein ring grooves are provided on the inside of the shells, and the ring grooves cooperate with the ribs for at least one of fixing the shells axially and fixing the shells tangentially.

6. A cutting arrangement according to claim 4, wherein ring grooves are provided on the inside of the shells, and the ring grooves cooperate with the ribs for fixing the shells tangentially.

7. A cutting arrangement according to claim 1, wherein said shells comprises a first shell and a second shell, and wherein the first shell comprises a first fastening means and the second shell comprises a second fastening means for connection of the first shell with the second shell on the roll core.

8. A cutting arrangement according to claim 1, wherein in the vicinity of the axial or tangential ends of the shells, the bristles incline towards the respective end, in particular combining with a radius to make an angle of b>0°.

9. A cutting arrangement according to claim 1, wherein two adjacent ones of the shells interengage with one another by way of projections in the vicinity of their respective tangential ends.

10. A cutting arrangement according to claim 1, wherein the shells are disposed adjacent to one another with gaps between each two adjacent ones of the shells, and the bristles extend outwardly at angles at least in areas adjacent to the gaps to cover the gaps between adjacent shells.

11. A cutting arrangement according to claim 1, wherein said shells of the brush roll comprise a plurality shells disposed adjacent to one another in an axial direction along the roll core.

12. A cutting arrangement according to claim 11, wherein adjacent ones of said plurality of shells disposed adjacent to one another in the axial direction are separated by a gap therebetween, and the bristles extend outwardly at angles at least in areas adjacent to the gaps to cover the gaps between the adjacent shells.

13. A shell for being fixed to a roll core, the shell comprising:

a. a basic structure having a cross-sectional shape of a segment of a circle, said basic structure having a substantially convex outside and a substantially concave inside;

b. bristles which project outwards from the outside;

c. torque-transmission means for transmitting torque from the roll core to the basic structure;

d. fastening means for fixing the basic structure to the roll core, wherein the fastening means is a threaded pin having an external thread;

e. receiving means for receiving said threaded pin, wherein the receiving means comprises a through hole having an internal thread for receiving the threaded pin and wherein the through hole extends radially concerning the circle;

f. wherein said external thread comprises distal and proximal thread portions such that for fastening to said roll core, said distal thread portion is engaged with said internal thread of said through hole and said proximal thread portion projects radially inwards concerning the circle from said inside of the basic structure for engaging said roll core; and g. wherein the diameter of the proximal thread portion is larger than the diameter of the distal thread portion.

14. A shell according to claim 13, wherein the through hole is arranged centrally between two phases of the shell.

15. A shell according to claim 13, wherein the through hole is arranged centrally in the axial direction of the shell.

16. A shell according to claim 13, wherein the shell comprises ring grooves provided on the inside of the shell for fixing the shell in an axial direction.

17. A shell according to claim 16, wherein each of the ring grooves comprises at least one axial edge oriented transversally to the circle.

18. A shell according to claim 13, wherein the shell is made of plastic material.

19. A shell according to claim 13, wherein the pitch of the proximal thread portion is larger than the pitch of the distal thread portion.

20. A cutting arrangement which is disposed on a path of travel of a web of corrugated board that is continuously produced by a corrugating machine, the cutting arrangement comprising:

a. a blade shaft which is mounted on a blade-shaft axis of rotation for drivable rotation and which comprises at least one circular blade thereon; and b. a brush roll, which is disposed opposite to the blade shaft and mounted for rotation about an axis of rotation, for supporting the web of corrugated board which passes between the circular blade and the brush roll when the web of corrugated board is cut by the at least one circular blade;

c. the brush roll comprising shells which are disposed on and surround a roll core and have a cross-sectional shape of a segment of a circle, wherein each shell has i. an outside and an inside, the inside faces towards the roll core;

ii. bristles which stand out from the outside;

iii. torque-transmission means for transmitting torque from the roll core to the shells; and iv. fastening means for fixing the shells to the roll core;

d. wherein threaded holes are radially provided in the roll core and on the inside of the shells, respectively accommodating the fastening means for non-rotary connection of the shells with the roll core;

e. wherein the fastening means comprises a fastening pin, and the fastening pin comprises two threaded portions of different pitches;

f. wherein said fastening means fixes the shells directly to the roll core;

g. wherein a first of the threaded portions of the fastening pin is engaged with the threaded hole on the shell, and a second of the threaded portions of the fastening pin is engaged with the threaded hole on the roll core, and the second threaded portion of the fastening pin has a larger pitch than the pitch of the first threaded portion of the fastening pin; and h. wherein the second threaded portion of the fastening pin is of a larger diameter than the first threaded portion of the fastening pin.

* * * * *